US006443331B1

(12) United States Patent
DeJonge

(10) Patent No.: US 6,443,331 B1
(45) Date of Patent: Sep. 3, 2002

(54) METERED DISPENSER WITH PULL FILL MECHANISM

(75) Inventor: Stuart DeJonge, Easton, PA (US)

(73) Assignee: Saint-Gobain Calmer Inc., City of Industry, CA (US)

( * ) Notice: Subject to any disclaimer, the term of this patent is extended or adjusted under 35 U.S.C. 154(b) by 0 days.

(21) Appl. No.: 09/983,357

(22) Filed: Oct. 24, 2001

(51) Int. Cl.[7] ..... B67D 3/00

(52) U.S. Cl. ..... 222/153.13; 222/309; 222/321.7; 222/481.5

(58) Field of Search ..... 222/153.13, 309, 222/321.7, 383.1, 485.1

(56) References Cited

U.S. PATENT DOCUMENTS 4,433,799 A * 2/1984 Corsette ..... 222/309
4,454,964 A * 6/1984 Sacher ..... 222/309
4,871,092 A * 10/1989 Maerte ..... 222/309
5,363,992 A * 11/1994 Meshberg ..... 222/309
5,411,181 A * 5/1995 Knickerbocker ..... 222/309
5,566,865 A * 10/1996 Jouillat et al. ..... 222/309
5,669,530 A * 9/1997 Cichon et al. ..... 222/309
5,772,080 A * 6/1998 De Pous et al. ..... 222/321.7
5,967,377 A 10/1999 Glynn ..... 222/158
6,230,942 B1 * 5/2001 Kuo ..... 222/481.5

* cited by examiner

*Primary Examiner*—Joseph A. Kaufman
(74) *Attorney, Agent, or Firm*—Dykema Gossett PLLC

(57) ABSTRACT

A hand-operated pump dispenser for dosing liquid product from a container includes a rotatable plunger assembly which is manually lifted upwardly relative to the dispenser body for drawing product into a pump chamber in a preselected amount depending on the rotational setting of the plunger, and which is manually depressed for completely discharging the contents of the chamber.

13 Claims, 1 Drawing Sheet

METERED DISPENSER WITH PULL FILL MECHANISM

BACKGROUND OF THE INVENTION

This invention relates generally to a manually actuated dispenser for the metered dosing of fluid from a container to which the dispenser is attached. More particularly, the dispenser has a variable volume pump chamber which is charged upon manually lifting or extending a plunger and is discharged upon manual plunger depression. The charging stroke is limited and may be selective.

The invention is an improvement over U.S. Pat. No. 5,967,377 disclosing a metered dispenser having a variable volume pump chamber which is charged to a measured volume as indicated by a marking on the plunger, and which is discharged by inverting the metered dispenser. The charged volume of the chamber cannot, however, be controlled with any precision since the metering element which defines a pump cylinder is lifted to draw a selected amount of fluid into the chamber as determined by markings on the metered element which indicate predetermined liquid volumes therein. Moreover, the metered dispenser has limited use in that it must be inverted to permit fluid to drain from the metering element by gravity or to be expelled by squeezing the liquid dispenser and/or the metering element. However, if the liquid is viscous, the contents of the pump chamber may not be fully discharged by gravity or even by squeezing the dispenser or the metering element. Besides, the vertically slidable metering element could shift easily in the process of being inverted during discharge whereby additional liquid would fill the metering element inadvertently, thereby affecting the accuracy of the doser.

SUMMARY OF THE INVENTION

It is therefore an object of the present invention to provide a metered dispenser which avoids the drawbacks of the known prior art dosers and which is capable of accurately metering liquid product in an upright position.

Another object is to provide a metered dispenser having at least one limit stop for limiting the extractable plunger for suctioning a predetermined volume of product into the pump chamber such that upon full depression of the plunger assembly, an accurate amount of product is dosed through a valve control discharge passage which may be in the form of a spout.

The plunger of the dispenser according to the invention is rotatable amount is central axis and has at least one radial projection which bears against a limit stop when lifted to extract liquid from the container to which the dispenser is mounted. The dispenser may have a plurality of limit stops in stepped formation respectively associated with indicia marked in accordance with the predetermined setting. A lock shoulder cooperating with the radial projection may be provided for locking the plunger in its fully depressed position.

Other objects, advantages, and novel features of the invention will become more apparent from the following detailed description of the invention when taken in conjunction with the accompanying drawings.

DETAILED DESCRIPTION OF THE INVENTION

Figure 1:
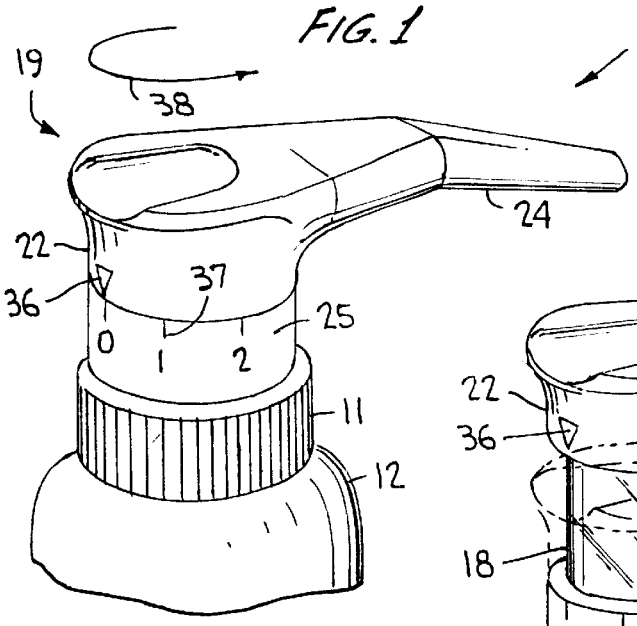
FIG. 1 is a perspective view of the metered dispenser of the invention shown in its fully depressed position.
Figure 2:
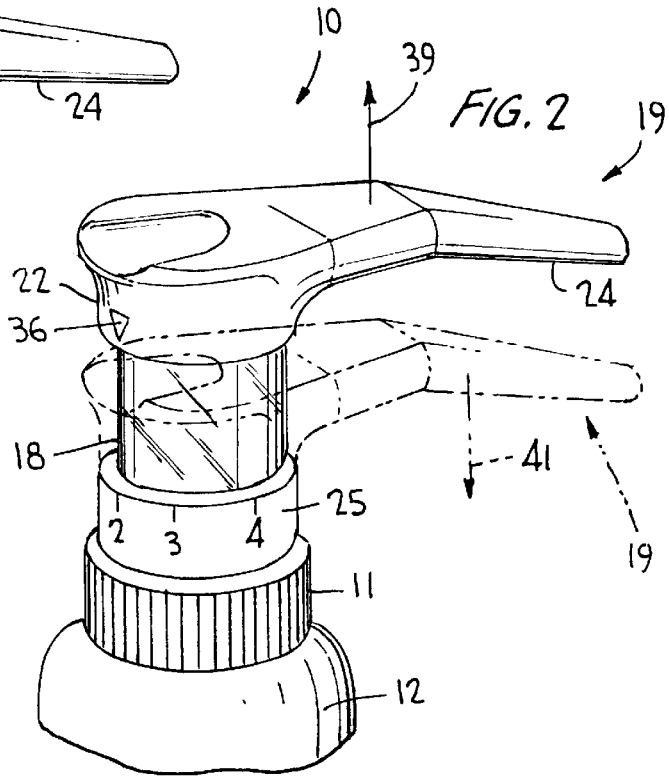
FIG. 2 is a view similar to FIG. 1 showing the plunger in its outwardly extended or lifted position.
Figure 3:
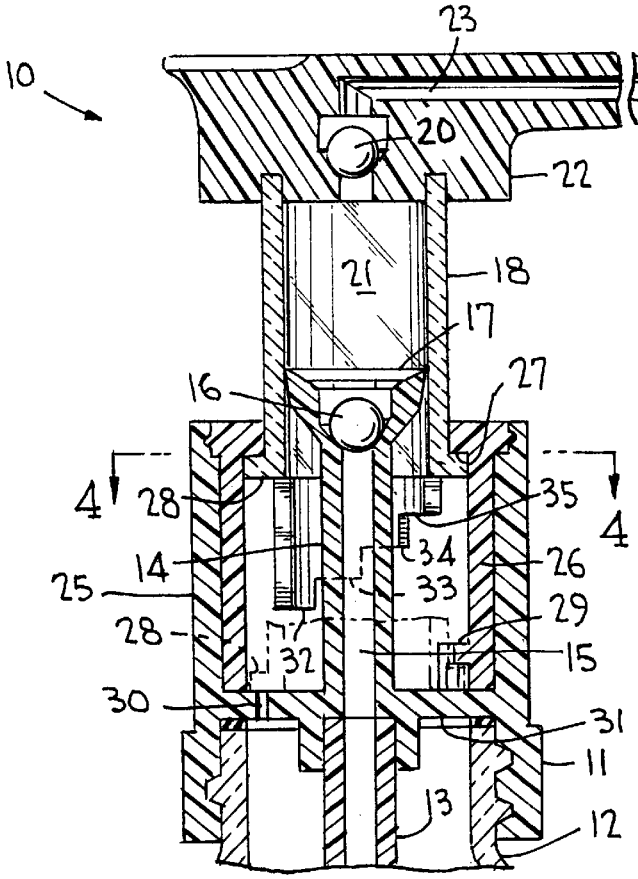
FIG. 3 is a vertical sectional view of the metered dispenser of the invention shown mounted on the neck of the container of product to be dispensed.

Turning now to the drawings wherein like reference characters refer to like and corresponding parts throughout the several views, the metered dispenser according to the invention is generally designated 10 in FIGS. 1 to 3 and is shown in detail in FIG. 3 in the fully extended position of the plunger. The dispenser 10 includes a dispenser body having a closure 11 for mounting the dispenser to a container 12 of product to be dispensed. The closure suspends a conventional dip tube 13 which extends into the container and defines together with a hollow upstanding pump piston 14 an inlet passage 15 valved as by an inlet check valve 16. The piston has a valve seal 17 at its upper end in sliding sealing engagement with cylindrical skirt 18 of plunger assembly 19, the skirt essentially defining a pump cylinder which reciprocates manually relative to the stationary piston. Valve seal 17 may comprise a separate part secured to piston 14 in some manner, or may be integral with the piston.

The piston and cylinder together define a variable volume pump chamber 21 for containing a metered amount of liquid product drawn from the container. The plunger assembly further includes a plunger head 22 having formed therein a discharge passage 23 valved as by a one-way check valve 20 and terminating in a discharge spout 24.

The closure has an upstanding sleeve 25 containing a cylindrical liner 26 fixed within sleeve 25 in some normal manner. The liner has at its upper end an inner annular flange 27 or the like for arresting upward movement of the plunger assembly to its fully extended position of FIGS. 2 and 3 as a pair of opposing radially extending projections 28 on skirt 18 bear against flange 27 as shown in FIG. 3. Of course, only one of such projections 28 need be provided, and the liner may be removably mounted within sleeve 25 so as to be replaceable by a different set of stops, or may be integral with sleeve 25.

Plunger assembly 19 is rotatable about the central axis of cylindrical skirt 18 and is manually reciprocable between the upwardly extended position of FIGS. 2, 3 and the fully depressed position of FIG. 1. Liner 26 has at its lowermost end a projection 29 extending radially inwardly and spaced a predetermined distance from top wall 31 of the closure. Thus, in the fully depressed position of the plunger assembly with the skirt 18 shown in phantom outline in FIG. 3, one of the projections 28 can be rotated to underlie projection 29 for locking the plunger assembly in its fully retracted position of FIG. 1.

Top wall 31 of closure 11 is provided with a vent port 30 through which atmospheric air passes into the container during each upward reciprocation of the plunger so that product drawn from the container is displaced with air to avoid container collapse. The inner diameter of annular flange 27 is slightly less than the outer diameter of skirt 18 so as to define a slight annular gap therebetween forming a passage for the entry of air into the container together with vent port 30 in any uplifted position of the plunger from that shown in phantom outline in FIG. 3. In the plunger lock-down position shown in phantom outline in FIG. 3, projection 28 bear against the upper surface of top wall 31.

Figure 4:
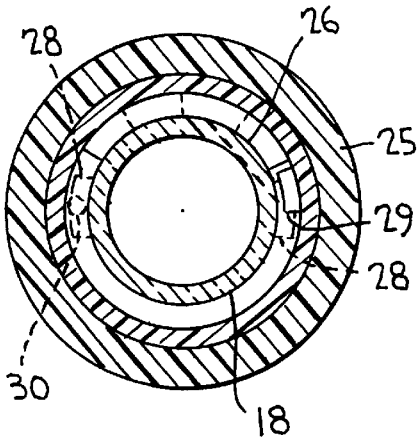
FIG. 4 is a sectional view taken substantially along the line 4—4 of FIG. 3.

The vent port 30 is located in wall 31 at such a location as to be covered by one of the projections 28 in the plunger lock-down position shown in phantom in FIGS. 3 and 4. Also the vent port is shown located at a 180° spacing from projection 29 such that in the plunger lock-down position the vent port is sealed closed by one of the projections 28 which is located opposite that projection 28 which underlies projection 29. Otherwise vent port 30 can be located as to be covered by that projection 28 which underlies projection 29.

The liner is further provided with one or more additional limit stops presenting stop shoulders 32, 33, 34 and 35 in stepped form each presenting a gradually higher stop for limiting the outward extent of the plunger assembly upon rotation of the plunger placing a projection in alignment with a selected one of the stop shoulders.

Indicia in the form a triangular or the like marker 36 may be provided on the plunger head near the lower edge thereof, and spaced indicia such as the numbers "0", "1", "2", etc., with vertical markers such as 37 can be provided on sleeve 25, with the spacing of markers 37 coinciding with the effective width of each of the respective stop shoulders 32 to 35.

Thus, in operation, the metered dispenser would be shipped mounted on container 12 filled with product to be dispensed and shelved in its fully retracted and locked position of FIG. 1. In such position marker 37 is at the "0" setting indicating a locked position. When plunger assembly 19 is rotated in the direction of curved arrow 38 of FIG. 1, the plunger assembly is unlocked and is now capable of being lifted by the operator to any of its settings 1, 2, 3, 4, etc., depending on the extent of plunger assembly rotation. Assuming the plunger assembly is rotated such that marker 36 coincides with marker 37 at the 2 position, one of projections 28 on sleeve 18 will have been rotated into alignment with stop shoulder 33 such that on pulling the plunger assembly in the direction of arrow 39, its outward extent is limited by bearing engagement between established projection 28 and stop shoulder 33. Therefore only a predetermined amount of liquid is drawn into chamber 21 by the suction created upon expansion of chamber during upward movement of sleeve 18 which draws product up through inlet passage 15 from the container and into the pump chamber via open ball check valve 16. The metered amount of liquid in chamber 16 may then be discharged from the chamber upon simply manually applying a downwardly depressing force to the plunger head in the direction of arrow 41 shown in FIG. 2 with the plunger shown in phantom outline. When the plunger is depressed to its fully compressed position of FIG. 1 and shown in phantom outline in FIG. 2, the entirety of the measured product is discharged from pump chamber 21. Then while the plunger assembly is in its fully depressed position, it may be rotated clockwise back to its "0" position, whereupon it is again locked in the FIG. 1 position and cannot leak through either check valve 16 or 20 in the locked position even when tipped over since the plunger chamber has been completely evacuated.

On the next use opportunity by the operator, the plunger head is rotated counterclockwise in the direction of arrow 38 until its marker 37 coincides with a selected setting whereupon the plunger head is pulled upwardly in the direction of arrow 39 such that projection 28 again underlies one of the stop shoulders 32 to 35 to which it is placed in alignment for withdrawing a preselected volume of liquid product from the container up through inlet passage 15 and into the pump chamber whereafter upon manual depression of the plunger head to its position in phantom outline in the direction of arrow 41 of FIG. 2, the entirety of pump chamber 21 is discharged through discharge spout 24 to its intended target. And, while in the fully depressed position, the plunger assembly simply need be rotated again in a clockwise direction until its marker 36 reaches the "0" position at which position the plunger assembly is locked in place in its FIG. 1 position.

In the plunger lock-down position the container is sealed against leakage through the vent port which is sealed tightly closed by one of projections 28 which overlies the vent port in the tightly locked position. When the plunger is rotated counterclockwise to unlock it, the vent port is opened and air is drawn into the container as the plunger is uplifted which expands chamber 21 creating a sub-atmospheric condition permitting product to be drawn at its atmospheric level within the container up through passage 15 and into the chamber. This product is displaced with air through the vent passage formed by the annular space between skirt 18 and flange 27 and by vent port 30. Since after each use the dispenser head is depressed and locked in its down position, the dispenser package is sealed against leakage even when dropped, tilted on its side, or inverted.

Obviously, many modifications and variations of the present invention are made possible within the light of the above teachings. It is therefore to be understood that within the scope of the appended claims the invention may be practiced otherwise than as specifically described.

What is claimed is:

1. A hand-operated pump dispenser for dosing liquid product from a container, comprising a dispenser body having a closure for mounting the body to the container, a hollow valved piston on said body, and a rotatable plunger assembly mounted on said body for reciprocating movement between at least one extended position outwardly of said body and a fully retracted position toward said body in a substantially upright attitude of the dispenser, the plunger assembly including a cylinder in sliding sealing engagement with said piston to therewith define a variable volume pump chamber in communication with the liquid product through the hollow piston, the body having a plurality of limit stops for limiting movement of the assembly to a selected one of said stops outwardly of the body upon rotation of the plunger assembly for drawing a predetermined amount of product into the chamber upon movement thereof to the at least one extended position, the predetermined amount being dispensed from the assembly upon movement thereof to the fully retracted position while in the upright attitude.

2. The pump dispenser according to claim 1, wherein the plunger assembly further includes a valved discharge passage in communication with said chamber.

3. The pump dispenser according to claim 1, wherein said cylinder has at least one projection lying in the path of one of said limit stops to effect the limiting movement of the assembly.

4. The pump dispenser according to claim 3, wherein said cylinder is rotatable about its axis relative to the body for moving the projection into the path of said a selected one of the limit stops to effect the limiting movement of the assembly.

5. The pump dispenser according to claim 4, wherein said limit stops and said at least one projection are located on a liner mounted within a sleeve extending from the closure of the dispenser body.

6. The pump dispenser according to claim 1, wherein said cylinder is rotatable about its axis relative to the body and has at least one projection lying in the path of one of said stops to effect the limiting movement of the assembly.

7. The pump dispenser according to claim 6, wherein the dispenser body has an inwardly located abutment with which the projection engages upon rotation of the cylinder for locking the plunger assembly in the retracted position.

8. The pump dispenser according to claim 1, wherein said cylinder is rotatable about its axis relative to the body for moving a projection on the assembly into engagement with an inwardly located abutment provided on the dispenser body for locking the plunger assembly in the full retracted position.

9. The pump dispenser according to claim 1, wherein said limit stops are located on a liner mounted within a sleeve extending from the closure of the dispenser body.

10. The pump dispenser according to claim 1, wherein the cylinder is rotatable about its axis relative to the body, and a single marking provided on said assembly aligns with one of a selection of indicia on the body for selecting one of the limit stops upon rotation of the cylinder.

11. The pump dispenser according to claim 1, wherein said cylinder is rotatable about its axis relative to the body for moving a projection on the assembly into engagement with an inwardly located abutment provided on the dispenser body for locking the plunger assembly in the full retracted position.

12. A hand-operated pump dispenser for dosing liquid product from a container, comprising a dispenser body having a closure for mounting the body to the container, a hollow valved piston on said body, and a rotatable plunger assembly mounted on said body for reciprocating movement between at least one extended position outwardly of said body and a fully retracted position toward said body in a substantially upright attitude of the dispenser, the plunger assembly including a cylinder in sliding sealing engagement with said piston to therewith define a variable volume pump chamber in communication with the liquid product through the hollow piston, the body having at least one limit stop for limiting movement of the assembly outwardly of the body for drawing a predetermined amount of product into the chamber upon movement thereof to the at least one extended position, said cylinder having at least one projection lying in the path of said limit stop to effect the limiting movement of the assembly, the predetermined amount being dispensed from the assembly upon movement thereof to the fully retracted position while in the upright attitude, and the closure having an upper wall with a container vent port covered in the fully retracted position by the projection on the cylinder.

13. The pump dispenser according to claim 12, wherein the dispenser body has an inwardly located abutment with which the projection engages for locking the assembly in the fully retracted position at which the vent port is sealed closed.

* * * * *